US005426950A

United States Patent [19]

Ament et al.

[11] Patent Number: 5,426,950

[45] Date of Patent: Jun. 27, 1995

[54] REFRIGERANT SEPARATION APPARATUS AND METHOD

[76] Inventors: Jon Ament, 2605 Little John La., Austin, Tex. 78704; David C. Culver, 12,000-D U.S. Hwy. 290 West, Austin, Tex. 77873

[21] Appl. No.: 290,685

[22] Filed: Aug. 15, 1994

Related U.S. Application Data

[63] Continuation of Ser. No. 98,618, Jul. 23, 1993, abandoned.

[51] Int. Cl.[6] ..... F25B 47/00

[52] U.S. Cl. ..... 62/85; 62/475

[58] Field of Search ..... 62/85, 475, 195, 292, 62/149, 470, 472, 474

[56] References Cited

U.S. PATENT DOCUMENTS

| | | | |
|---|---|---|---|
| 1,911,464 | 5/1933 | Pearson | 62/195 |
| 5,167,126 | 12/1992 | Cartwright | 62/475 |
| 5,187,953 | 2/1993 | Mount | 62/475 |
| 5,189,882 | 3/1993 | Morgan, Sr. | 62/475 |
| 5,241,837 | 9/1993 | Albertson, III | 62/475 |

OTHER PUBLICATIONS

Carolina Products, Inc. Tri-Stage High Efficiency Modular Purge Systems, Four Pages.

Carrier Corp., PreVent high-efficiency purge add-on, Two Pages.

Trane, Purifier Purge, 1991, One Page.

Redi/Controls, Refrigerant Mizer PE-2000, Two Pages.

*Primary Examiner*—John M. Sollecito

*Attorney, Agent, or Firm*—Jack W. Hayden

[57] ABSTRACT

Plural heat extraction arrangements are provided which are preferably associated with a separation vessel (50). The heat extraction arrangements can function in a vertical, horizontal, or any position between horizontal and vertical while receiving a refrigerant from a source unit (48) and a heat extraction substance supplied to at least one heat extraction arrangement by a device (90) for subjecting the refrigerant to a plurality of heat extraction steps, or relationships, for separating the refrigerant into a gas portion and a liquid portion. Traps 60 and 60' are provided for receiving the liquid portion to separate the liquid, as desired, from subsequent heat extraction steps. The liquid portion and a gas portion are separately discharged from the vessel.

7 Claims, 8 Drawing Sheets

48
50
66a
52
52a
72
64b
62a
64c
63
66b
51
72a
62'
51b'
51a'
51b''
51'
62e
51a''
62b
51b
51a
51d
51a'''
67
70
71
51b'''
64d
62c
54
65
64
64a
62
65a
62d
54a
90
60'
75
58a
58
60

REFRIGERANT SEPARATION APPARATUS AND METHOD

This is a continuation of application Ser. No. 08/098,618 filed on Jul. 23, 1993, now abandoned.

STATEMENT OF THE PRIOR ART

Refrigerants are well known to those skilled in the art. They are used as the operating fluid for moving heat from one location to another. They are normally contained in some manner such as, by way of example only, in systems, vessels, containers and the like.

The use of separation vessels to separate non condensible gases, such as, by way of example only, air and/or other non-condensible gasses from a refrigerant employed with various equipment is well known to those skilled in the art. Such equipment which is well known to those skilled in the art, by way of example only, may be purge, recycle and recovery units either alone or in various combinations.

The above equipment employs controls which are well known to any person skilled in the art to control the flow of refrigerant to be treated therethrough and the flow of refrigerant to be treated through the separation vessel to separate the non condensible gases from the refrigerant being treated and to release the non condensible gases to the atmosphere.

Prior art separation vessels are constructed, so far as known to applicants, to utilize only one particular type of heat extraction substance to extract heat from a refrigerant and to separate the non condensible gases from the refrigerant.

Where prior art separation vessels are used with equipment which supply the heat extraction substance, such as by way of example only and not by limitation, a chiller, it is generally understood that the separation vessels can operate only when the chiller is in operation.

Also, so far as known to applicants, prior art separation vessels are not capable of functioning in a horizontal position and in vertical position, or in any desired position between vertical and horizontal position which may complicate, or limit adapting prior art separation vessels with equipment with which it is to be employed.

Various forms of refrigerant purge units, as such, as well as refrigerant recovery units, as such, are well known and shown in the prior art; however, recent pending legislation regulates discharge of refrigerants to the atmosphere and requires handling refrigerants to prevent escape to the atmosphere beyond certain limits.

Chillers have been used to provide heat extraction substance for heat removal from a refrigerant being treated in a separation vessel to separate non condensible gases from the refrigerant. When refrigerant handling devices, such as by way of example only and not by limitation, chillers are employed in various applications well known to those skilled in the art, such devices may experience pressure below atmospheric, particularly when not in operation. This may result in leaks in the seals enabling the atmosphere to mix with the refrigerant. The atmospheric gases must then be separated from the refrigerant to enable the equipment utilizing the refrigerant to function properly.

With recent concern about the depletion of the earth's atmospheric ozone, steps have been taken to enact new laws requiring better management and a schedule for the phase out of certain agents believed to deplete ozone. Low pressure refrigerants have become one of the targets. Generally speaking, presently available purge units used to purge the non condensible gases from refrigerants, such as by way of example only and not by way of limitation, refrigerants associated with a chiller, do not have the ability to do so unless the chiller, is operating. Thus when the chiller begins operation after shutdown and is then purged to remove non condensible gases therefrom by most presently available purge units employing prior art separation vessels, the volume of refrigerant discharged to the atmosphere may increase above desirable limits.

Also, prior art separation vessels are not readily adaptable for use interchangeably with various purge units.

SUMMARY OF THE INVENTION

An object of the present invention is to provide refrigerant separation apparatus and method which overcomes the above and other problems present in the prior art.

A further object is to provide apparatus and method for condensing refrigerant from gases, such as air wherein a substantially constant volume of refrigerant gas mixture may be treated in an uninterrupted flow path through the apparatus and method while maintaining a high degree of separation efficiency of the refrigerant from the gases even though the ratio of gases to refrigerant may vary substantially.

Another object of the present invention is to provide a separation vessel with which more than one heat extraction substance may be employed and thus does not require the separation vessel to rely upon the equipment that contains the refrigerant being treated to also provide the heat extraction substance for the separation vessel.

Another object of the present invention is to provide apparatus including a separation vessel which can function in both a vertical or horizontal position for condensing refrigerant to a liquid and discharging the remaining gases to atmosphere.

Another object of the invention is to provide apparatus including a separation vessel and method for use with equipment which does not require that the equipment be in operation for the separation vessel to function in its intended manner.

Another object of the invention is to use a refrigerant purge unit, or a refrigerant recovery unit, or a refrigerant recycle unit each individually, or as a combination refrigerant purge/recovery/recycle unit, as the supply source to supply the refrigerant to be treated and as part of an apparatus and method for subjecting the refrigerant to a first and then other heat extraction steps in a separation vessel, which apparatus and method enables a liquid portion to be separated from the remaining gas portion after each heat extraction step and a liquid portion discharged from the refrigerant being treated before each of the remaining heat extraction steps.

Another object of the invention is to employ standard off the shelf items in a novel refrigerant separation apparatus and method which can be used in any position between a vertical position or a horizontal position.

A further object of the present invention is to provide refrigerant separation apparatus and method for use with refrigerant purge units, recovery units and recycle units, alone or in any combination of the foregoing units as a refrigerant source, or source unit, to supply the refrigerant to be treated by the separation vessel of the present invention which purge, recovery or recycle units alone or in any combination may be free standing, or portable, or permanently mounted.

A further object of the present invention is to provide refrigerant separation apparatus and method for purging non condensible gases from a contained refrigerant supplied from a source.

An object of the present invention is to provide refrigerant separation apparatus and method which may be employed with refrigerant purge units, recovery units and recycle units, or any combination thereof for purging non condensible gases of a contained refrigerant that is in, by way of example only, one or more closed process systems such as chillers and then recover the contained refrigerant either while the chillers are operating or while shut off.

Still another object is to provide a method for purging non condensible gases from a contained refrigerant and recovering the contained refrigerant.

A further object of the invention is to provide apparatus and method for separating a refrigerant from a refrigerant source into a liquid and a gas.

Yet another object is to provide a refrigerant separation apparatus and method for separating a contained refrigerant into a gas portion and a liquid portion for use with a refrigerant purge/recovery unit that purges non condensible gases from a contained refrigerant and recovers the contained refrigerant.

Yet a further object of the invention is to provide an arrangement for separating a contained refrigerant from either a purge unit, or a recovery unit or a recycle unit into a gas portion and a liquid portion.

Still another object is to provide a separation vessel and method for use with a combination unit which combines a purge unit with a recovery unit, a purge unit with a recycle unit, a recycle unit with a recovery unit and a purge unit with a recovery unit and a recycle unit.

Another object of the invention is to use standard heat extraction substances with a separation vessel to treat a refrigerant in a plurality of heat exchange, or heat extraction steps, or relationships to remove heat from the refrigerant to separate it into a liquid portion and a gas portion and separate liquid from the gas portion between the plurality of heat exchange steps.

Another object of the invention is to treat a refrigerant in a separation vessel to enable a maximum amount of liquid refrigerant to drain from the separation vessel and discharge non condensible gasses to the atmosphere.

Other objects and advantages of the invention will become apparent from a consideration of the following description and drawings.

DESCRIPTION OF THE PREFERRED EMBODIMENTS

For purposes of description, the term "source" or "source unit" as used herein means any equipment which supplies a refrigerant to be treated, such as by way of example only and not by way of limitation, one or more purge units, one or more recovery units, one or more recycle units, or any combination or purge, recovery, and or recycle units. Other combinations may be possible. The construction and function of such equipment is well known to those skilled in the art.

For the purposes of description, the term "contained refrigerant" or "refrigerant" as used herein means refrigerant that is not loose in the atmosphere. It may also be used to apply to refrigerant used in any closed system, such as by way of example only, a refrigerant in a closed process system, such as a chiller, by way of example only or in a closed container or storage vessel which is connected with or communicated with the source or source unit that is to be treated by the separation vessel of the present invention.

The term "chiller", as used herein by way of example only, is an apparatus well known to those skilled in the art that operates on known thermodynamic principles for removing heat. It is also another example of a "source", or "source unit".

The term "heat extraction substance" as used herein means any fluid compatible with heat exchanger apparatus and which is capable of absorbing or removing heat. One preferred heat extraction substance is R-22 refrigerant, which may be supplied by any suitable self contained, portable refrigeration system, the construction and usage of which is well known to those skilled in the art.

The term "primary heat exchanger" as used in connection with the present invention refers to a type of heat exchanger, or other forms of heat extracting means which has a single wall separating the refrigerant being treated in the heat exchanger, from the heat extraction substance through which single wall the heat is conducted from the refrigerant being treated.

The term "secondary heat exchanger" as used in connection with the present invention refers to a type of heat exchanger, or heat extractor means which has more than one wall separating the refrigerant being treated in the heat exchanger, from the heat extraction substance through which walls the heat is conducted from the refrigerant being treated.

The invention is described as being assembled with copper components. Other materials well known to those skilled in the art may be used, depending upon the refrigerant to be treated.

Figure 2:
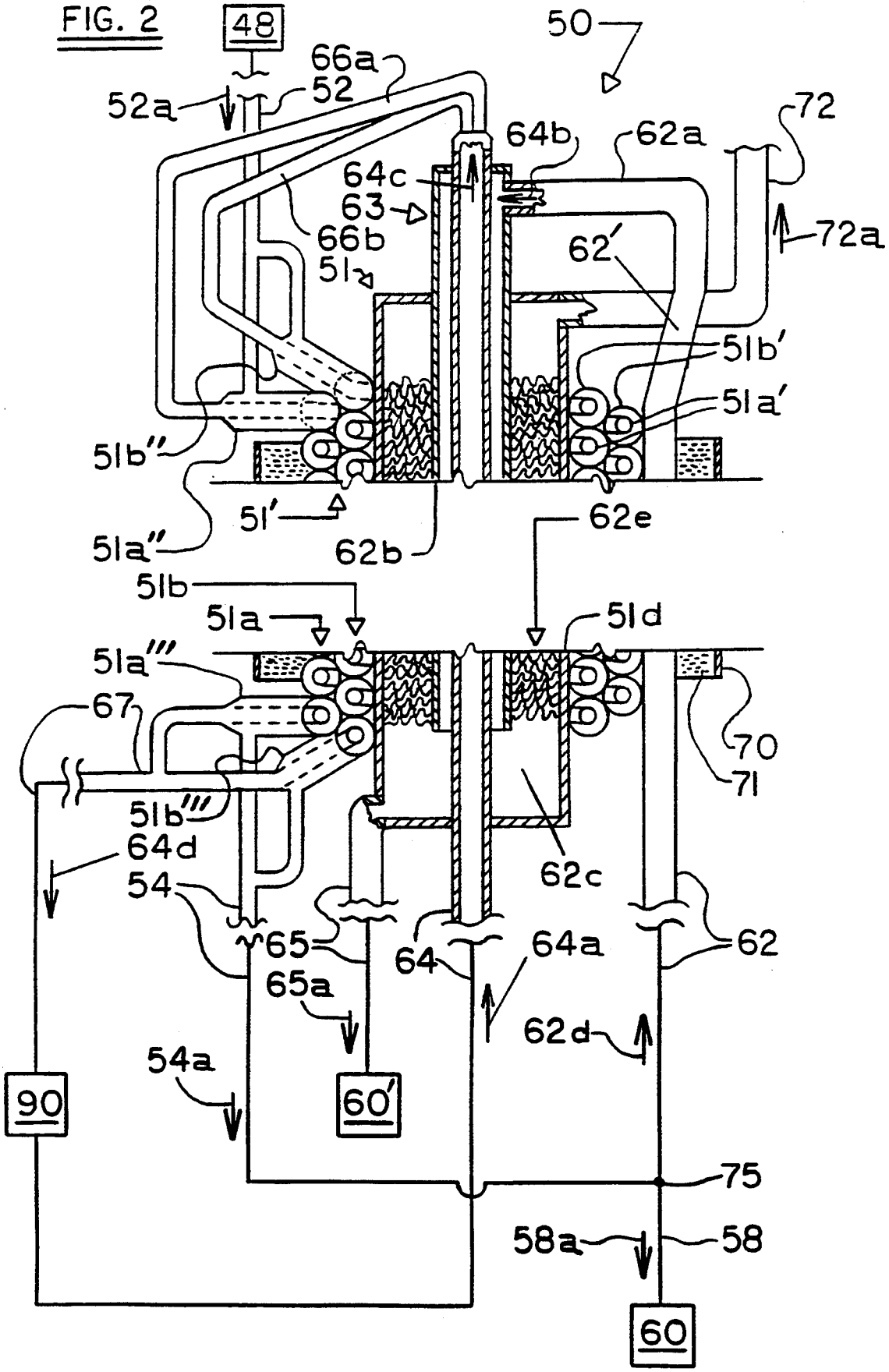
FIG. 2 is a vertical sectional view, partly schematic of the preferred form of the separation vessel of FIG. 1 shown connected with a source of refrigerant to be treated, and better illustrating details of the separation vessel housing, outer jacket, the tube type internal heat exchanger, the spiral coil type external heat exchanger, with the latter being partly in elevation and flow conduits associated with the vessel.

Attention is directed first to FIG. 2 of the drawings wherein a preferred form of the separation vessel 50 is illustrated. A source, or source unit, as above defined is represented schematically at 48, which as previously noted, the structure and function of which is is well known to those skilled in the art.

Combinations of units as the source, by way of example only and not by limitation, may be a purge unit with a recovery unit, a purge unit with a recycle unit, a recycle unit with a recovery unit or a purge unit with a recovery unit and a recycle unit.

A pump, not shown, of any suitable type well known to anyone skilled in the art may be separate from or associated with whatever equipment forms the source or source unit 48 for moving the refrigerant to be treated from the source 48 to the separation vessel 50. The pump may be turned on manually, or may be turned on automatically by any suitable arrangement well known to those skilled in the art to cause refrigerant to flow from the source 48 comprising any one of such units, or any combination thereof, to and through vessel 50 for treatment as hereinafter described.

In the preferred form shown in FIG. 2 the apparatus is positioned vertically and the contained refrigerant to be treated flows from source 48 through conduit 52 and into the uppermost spiral coils referred to generally at 51*a*″ and 51*b*″ of layered coils 51*a* and 51*b* adjacent the top end of external heat exchanger 51′ in contact with the vessel 50.

Figure 1:
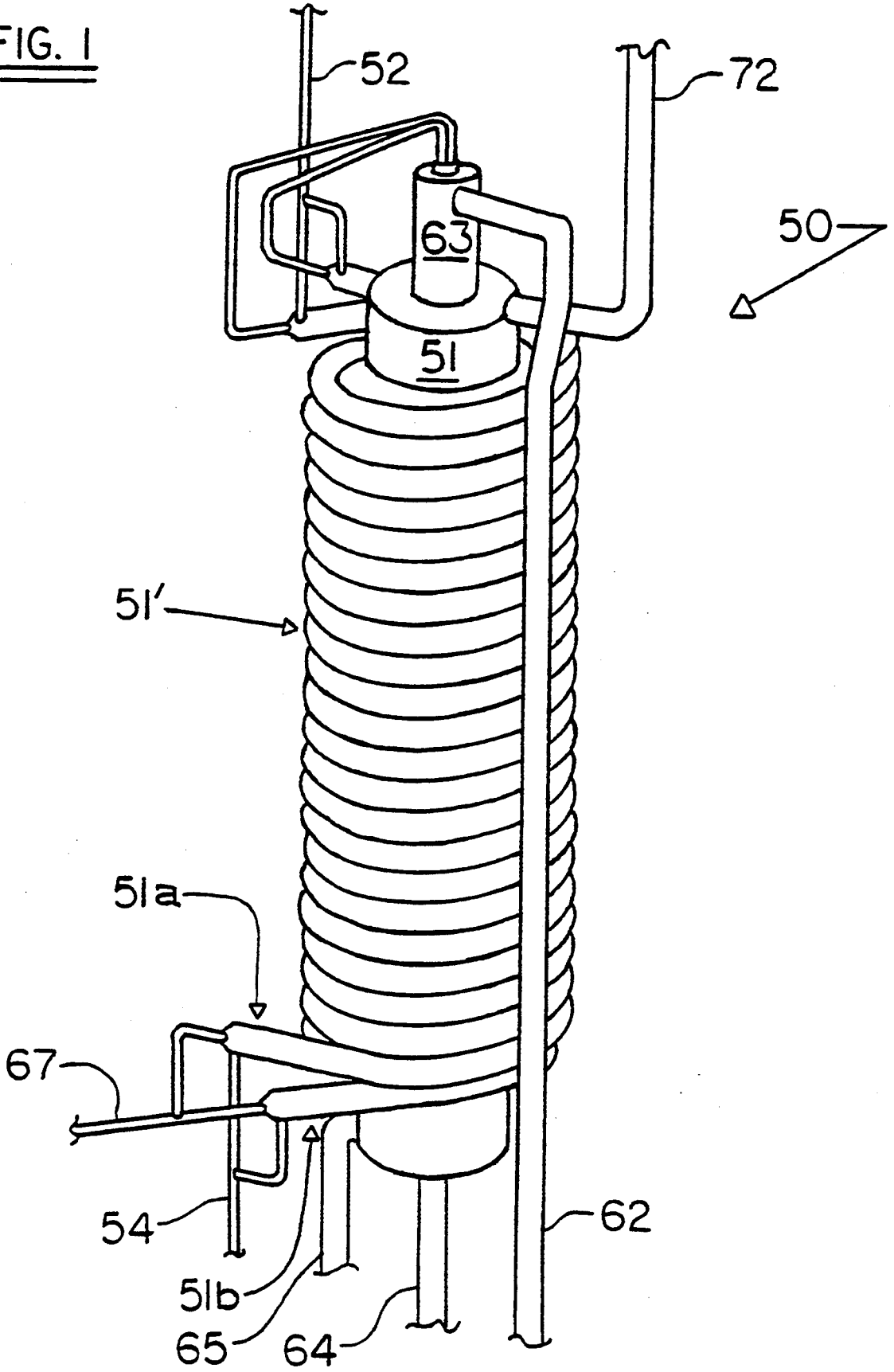
FIG. 1 is a perspective view of a preferred form of the separation vessel with the outer jacket and insulation removed for clarity to better view a preferred form of heat extraction means in the form of a spiral coil tube type external heat exchanger in contact with or closely adjacent the exterior of the separation vessel housing, a preferred form of connecting the external heat extraction means with a longitudinal tube type heat exchanger, or heat extraction means that is internally of the vessel housing, and a conduit arrangement for conducting a heat extraction substance from a device through the external and internal heat extraction means.
Figure 5:
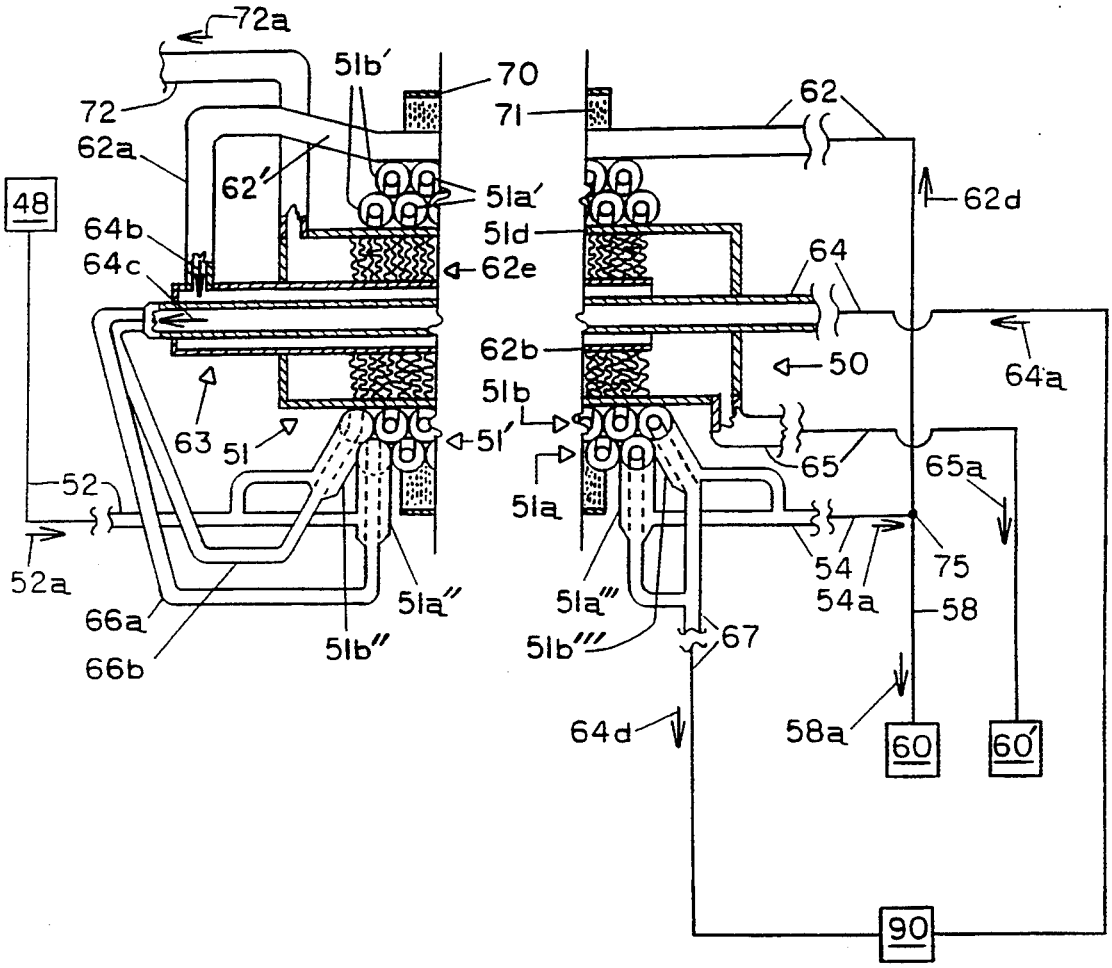
FIG. 5 is a vertical sectional view, partly schematic, and shows FIG. 2 rotated 90 degrees counter clock wise to position it for operation in a preferred horizontal form.
Figure 6:
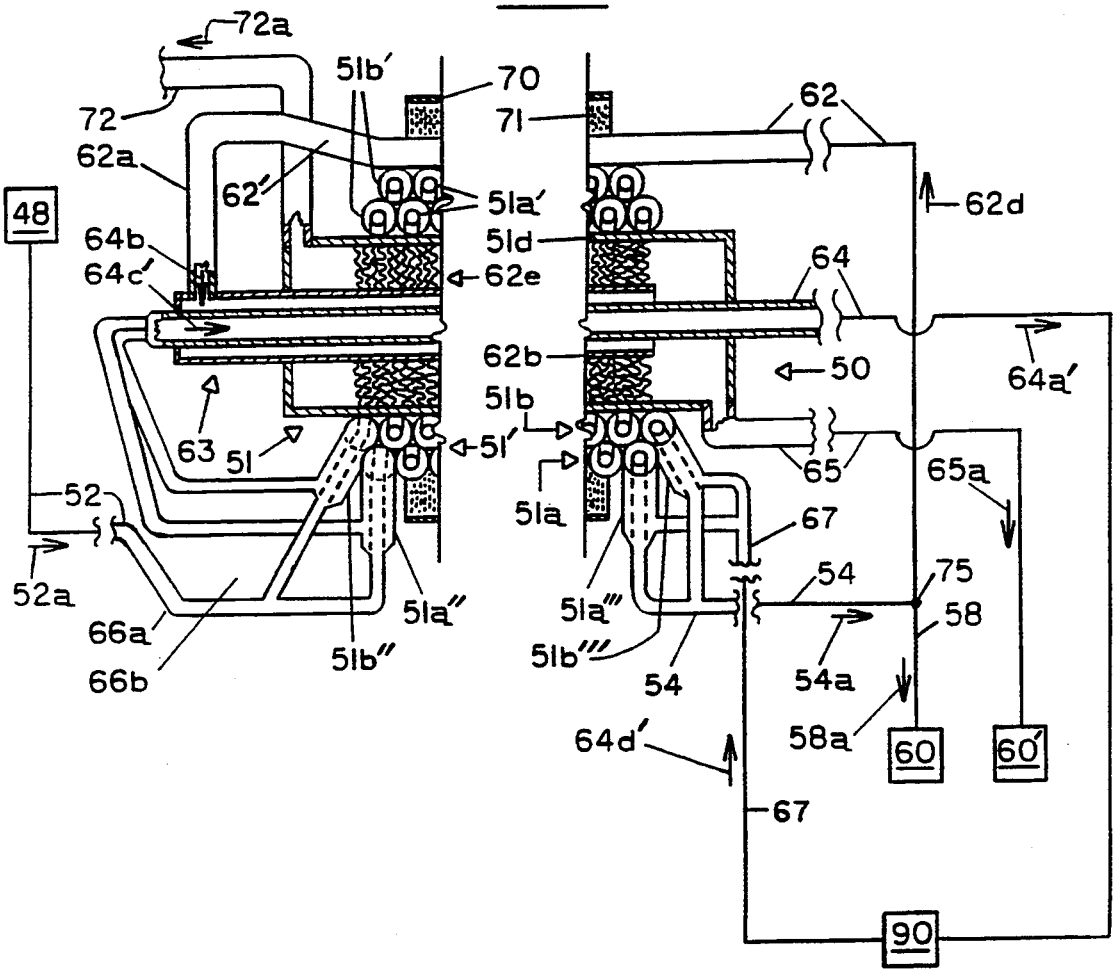
FIG. 6 is a vertical sectional view, partly schematic, and is a view similar to FIG. 5 showing the separation vessel and other components of the apparatus in an alternate horizontal form.
Figure 7:
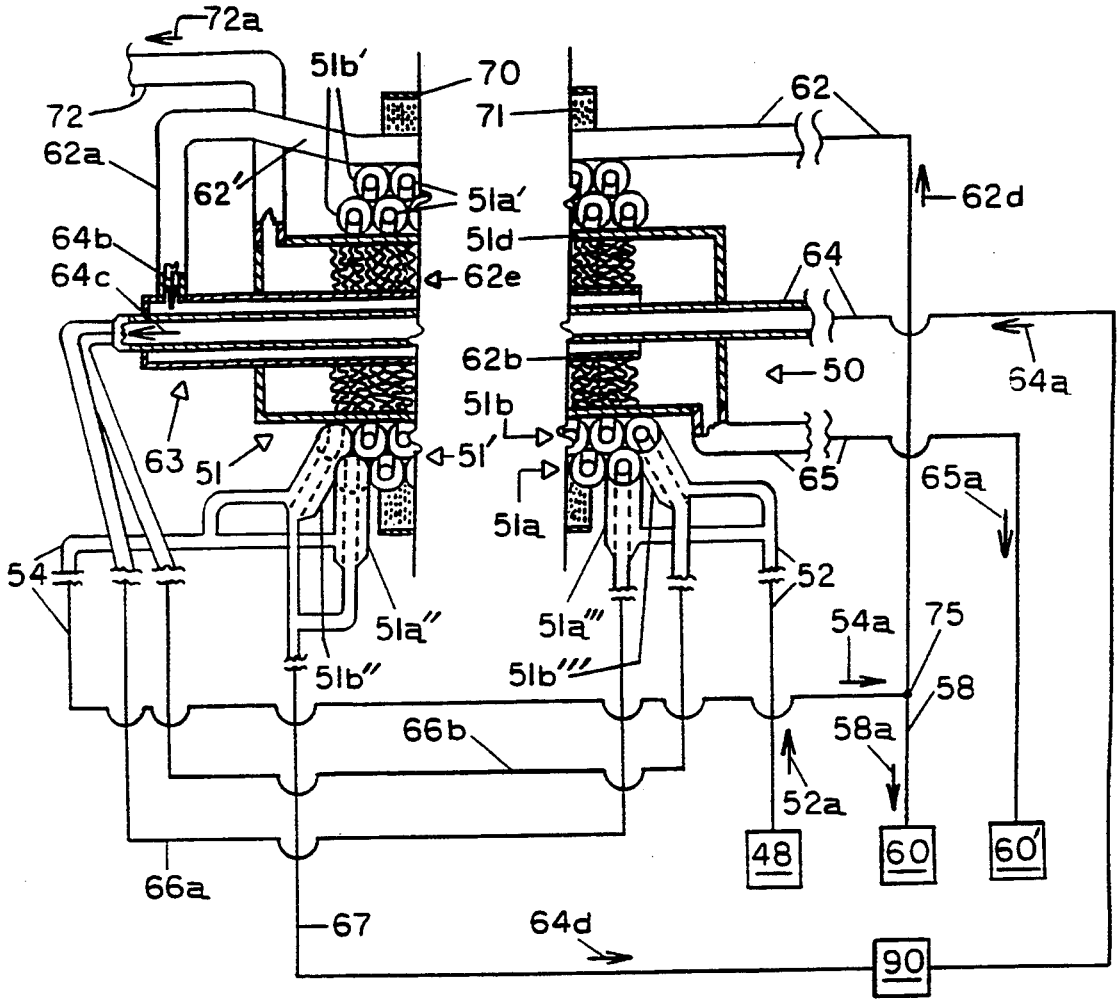
FIG. 7 is a vertical sectional view, partly schematic and is a view similar to FIG. 5 showing the separation vessel and other components of the apparatus in another alternate horizontal form.

The vessel 50 may assume various configurations and in the preferred form illustrated in FIGS. 1 and 2, it is shown as including a longitudinally extending housing, referred to generally at 51, which is shown as being tubular and positioned vertically to provide a top end and a bottom, or lower end on the vessel 50 when it is in a vertical position, or a left and right end when the vessel is positioned in a horizontal position, as shown in FIGS. 5–7 as will be described.

The conduits preferably assume the same vertical relationship to the vessel 50 as is shown in each of the drawings, whether the vessel 50 is used in a vertical position as shown in FIGS. 2–4 and 8, or a horizontal position as shown in FIGS. 5–7 for preferred operation of the apparatus.

An external heat exchanger is referred to generally at 51′ in the drawings. It is preferably formed by the stacked, or layered, spiral coil members, referred to generally at 51*a* and 51*b*, of a form well known to those skilled in the art, are mounted in contact with and extend circumferentially around and longitudinally along externally on, or closely adjacent, the housing 51 as shown in the drawings.

Preferably, the stacked or layered coils 51*a* and 51*b* of the external heat exchanger 51′ are continuous from adjacent the top end of the housing 51 to adjacent the bottom or lower end of the vertical vessel 50 to provide an apparatus for separation of the contained refrigerant being treated into a gas portion and liquid portion as it passes through the heat exchange steps or relationships as will be described.

The outer and inner layered or stacked spiral coils 51*a* and 51*b*, respectively, each include, or comprise, an inner tubular member 51*a*′ which extends through an outer tubular member 51*b*′. The outer tubular members 51*b*′ of the inner spiral coil layer 51*b* is in contact with the housing 51 of vessel 50 and the outer tubular members 51*b*′ of the outer spiral coil layer contact the outer tubular members 51*b*′ of the inner coil layer 51*b*. While two layers of spiral coils are shown as forming the first, external heat exchanger, the number of layers may vary to accomplish the desired heat extraction.

In the preferred form as shown in FIG. 2, the refrigerant that is to be treated is supplied from the source 48, through conduit 52. Arrow 52*a* in FIG. 2 represents the direction of flow from source 48 in conduit 52 of the refrigerant to be treated.

In the vertical form shown in FIG. 2, refrigerant to be treated enters adjacent or at the upper end of the external heat exchanger coils 51*a*″ and 51*b*″ on vessel 50 as shown in FIG. 2 and is subjected to a heat extraction step. This may be considered as an example of a primary heat exchanger and is the first heat extraction step or relationship.

A heat extraction substance may be supplied from the device 90 through conduit 64 shown in FIG. 2. The conduit 64 is sealably connected with and extends through the lower end of the housing 51 and is shown as extending through and sealably connected to the upper end of outer tube 62*b* as seen in the drawings. Conduit 64 extends longitudinally within and in circumferentially spaced relation to the longitudinally extending outer tube 62*b* which is in circumferentially spaced relation to housing 51. The portion of conduit 64 within housing 51 forms the inner tube, and outer tube 62*b* forms the outer tube of the internal type tube heat exchanger 63 as shown in FIG. 2. Tube 62*b* extends through and is sealably connected with the upper end of housing 51.

One flow path form of heat extraction substance as represented by arrows 64*a* in FIG. 2 is from the discharge outlet of device 90 through conduit 64 and the portion thereof forming inner tube 64 of internal heat exchanger 51′.

The heat extraction substance conveyed through conduit 64 to the interior of vessel 51 as above stated, is discharged from inner tube 64 as represented by arrow 64*c*, preferably in separate plural or multiple streams at or adjacent the upper end of the separation vessel with each stream flowing through a separate conduit, by way of example only, through two conduits 66*a* and 66*b* which are sealably connected to the upper end of conduit 64 as shown.

Where other than two layers of coils are employed in the external heat exchanger, a similar number of conduits is provided for conveying the streams of heat extraction substance from internal tube 64 of the internal heat exchanger.

As shown in FIG. 2 the heat extraction substance is conducted and discharged, preferably, from conduits 66*a* and 66*b* into the inner tubular members 51*a*′ of the uppermost coils 51*a*″ and 51*b*″ of the external heat exchanger 51′ and the refrigerant being treated is preferably discharged from conduit 52 into outer tubular members 51*b*′ of external heat exchanger 51′ as seen in FIG. 2.

The heat extraction substance is discharged from the external heat exchanger 51′ through conduit 67 at or immediately adjacent the lower end of the primary heat exchanger 51′ and is conducted back through conduit 67 as represented by direction of flow arrow 64*d* to the return inlet of device 90 shown in FIG. 2 of the drawings.

In the form of the apparatus shown in FIG. 2, the refrigerant treated by the heat extraction step in the external heat exchanger 51′ provides a condensed liquid portion and a gas portion which exits from the exchanger 51′ through conduit 54 as shown in FIG. 2.

When the vessel 50 is in the preferred vertical position the condensed liquid portion of the refrigerant flows by gravity through conduit 54, and then through conduit 58 which is connected to the conduit 54 as shown diagrammatically in FIG. 2 at a position below the intersection or junction 75 of conduit 54 and conduit 62 as shown in FIG. 2. The liquid flows from conduit 58 into any suitable liquid separation device, such as by way of example only, the float trap represented at 60, well known to those skilled in the art, such as by way of example only, Wright Austin brand model 90-AC which allows only liquid to flow through the trap and the gas portion is trapped, or retained. Liquid condensed from the refrigerant in the first heat extraction step by the external heat exchanger 51′ may be thus removed from the subsequent treatment steps to which the refrigerant is subjected.

It is to be noted from the foregoing description, and as will be noted with regard to all embodiments, trap means to receive liquid refrigerant resulting from the procedure is preferably provided in a manner so that the trap means is capable of receiving liquid from each heat extraction step and prior to the next heat extraction step, or between each heat extraction step. This arrangement enables prompt removal of as much liquid refrigerant as possible from the remaining heat extraction steps involved in the treatment of the refrigerant by the present invention. However, in some instances the trap means may be provided in a manner to receive liquid from only selected, and not each heat extraction step.

Liquid portion in the float traps in all forms of the apparatus shown in the drawings as well as those described herein is conveyed by a conduit (not shown) to a predetermined location (not shown), depending upon the operation being performed by source 48.

For example, if source 48 is a purge unit, the liquid portion from float trap 60 may be conveyed back to the closed process system from which it was taken. If source unit 48 is a recovery unit the liquid from trap 60 may be normally conveyed to a storage container or to other closed containers, such as storage containers or storage means.

If the source 48 is a combination of any one or more of purge, recovery, and/or recycle units, the liquid portion from trap 60 is conveyed to a predetermined location which is determined by the mode in which the combination source or source unit is operating as will be understood to those skilled in the art. That is, by way of example only, if the source is a combination of a purge and recycle unit, the contained refrigerant being treated may flow from a contaminated storage container into the source unit for treatment and leave the liquid trap into an uncontaminated storage container.

In FIG. 2, the gas portion is conveyed at the junction 75 from conduit 54 into conduit 62. The conduit 62 is connected to junction 75 and is shown as extending longitudinally and laterally spaced from the housing 51 by the first heat exchanger layered coils 51*a* and 51*b* with which it is in contact for heat exchange relationship with the gas portion flowing through conduit 62 to the internal heat exchanger 63 in the interior of the housing as shown in FIG. 2. This may be considered as an example of a secondary heat exchanger and is the second heat extraction step in the procedure of FIG. 2 of the present invention.

Liquid from the condensed refrigerant may flow down and through conduit 62 to the float trap represented at 60 which removes any trapped refrigerant liquid from further procedures of the present invention.

Conduit 62 includes a portion 62′ adjacent its upper end that is at a slight angle relative to vertical as shown in FIG. 2 when the vessel 50 is in a vertical position so that when the separation vessel 50 is positioned horizontally, as will be described, any liquid that may be condensed in tube 62 will flow to trap 60.

Conduit 62 is shown as preferably having a lateral portion 62*a* shown in FIG. 2 as adjacent its upper end which may be formed by a standard fitting, or in any other suitable manner well known to those skilled in the art, which connects with tubular portion 62*b* that extends longitudinally within housing 51 for conducting the gas portion from conduit 62 into the interior of the internal heat exchanger 63.

The third heat exchange relationship occurs in a primary heat exchange relationship when the gas portion from conduit 62 flows into and through the outer tube 62*b* of internal heat exchanger 63 as shown in FIG. 2 where the remaining gas portion of the refrigerant being treated is subjected to a third heat extraction step, or relationship for condensing a liquid portion from the gas portion which condensed liquid portion may fall to the lower end of annular space 62*c* inside housing 51. Liquid that flows by gravity to the lower end of vertically positioned housing 51 passes out through conduit 65 down to trap 60′ to separate the liquid from the remaining procedures of the present invention.

An annular space 62*c* is provided between the outer wall 51*d* of the housing 51 and the outer tube 62*b*, which annular space may be provided with a suitable matter or a suitable flow turbulence arrangement represented generally at 62*e* which creates a flow turbulence within the space 62*c* to provide multi-directional flow of the separated gas portion of the refrigerant prior to exiting it from the vessel 50, as will be described.

Where a matter is employed in the annular space 62*c*, it may be selected from the group comprising copper, diamonds, aluminum, brass, stainless steel, silver or gold, preferably in a wire mesh form to cause the gas flow to change directions as it passes there through which further may separate the refrigerant into a gas portion and a liquid portion. However, granular or other configurations of the matter may be used.

An arrangement may be a baffle of suitable configuration and having holes for passage of liquid portions and gas portions and which baffle is positioned to transmit heat to the coils of heat exchanger 51′ and to heat exchanger 63.

An additional secondary heat exchanger relationship occurs in annular space 62*c* which forms a fourth heat extraction step, or relationship.

External heat exchanger 51' extracts heat from the outer wall 51*d* of the housing 51 as well as from the substance or baffle arrangement in the annular space 62*c* which effects an additional heat exchange relationship with the remaining gas portion flowing through the substance or baffle arrangement in the annular space 62*c* within the housing 51 prior to discharge of the gas portion therefrom through conduit 72.

The non condensible gases in annular space 62*c* in the housing 51 of separation vessel 50 are discharged to atmosphere in the FIG. 2 form through an opening adjacent the upper end of the housing 51 of vessel 50 and through conduit 72 that is connected to the opening as shown in the drawings. If desired, a relief valve (not shown) of any suitable type well known to those skilled in the art that is either manually or automatically actuated may be connected with conduit 72 to vent the non condensible gases to atmosphere from conduit 72.

Liquid refrigerant condensed in annular space 62*c* may flow downward by gravity in housing 51 and is discharged from the housing 51 of the vessel 50 out the opening as shown in the drawings through conduit 65 to any suitable liquid separation device or float trap 60' similar to float trap 60 as seen in FIG. 2. It can be appreciated that conduit 65 and conduit 58 could be connected to a single liquid separation device by anyone skilled in the art.

The liquid portion from the float trap 60' in this heat extraction step may be conveyed back the same location to which the liquid portion from trap 60 is conveyed.

Arrow 52*a* in FIG. 2 represents the direction of flow from source 48 through conduit 52 of the refrigerant to be treated. The arrow 54*a* represents the direction of flow through conduit 54 of the gas portion and liquid portion of the refrigerant from heat exchanger 51'. Arrow 58*a* represents the direction of the condensed liquid portion flow of the refrigerant in conduit 58 from conduits 54 and 62. Arrow 62*d* represents the direction of the gas portion flow in conduit 62 of the refrigerant being treated that is received from conduit 54. Arrow 65*a* represents the direction of flow of the condensed liquid portion of the refrigerant received through conduit 65 from housing 51 to trap 60'. Arrow 72*a* represents the direction of the flow of the remaining gas portion of the refrigerant being treated received from housing 51 through conduit 72 that is subsequently expelled to atmosphere through any suitable means, not shown.

Figure 3:
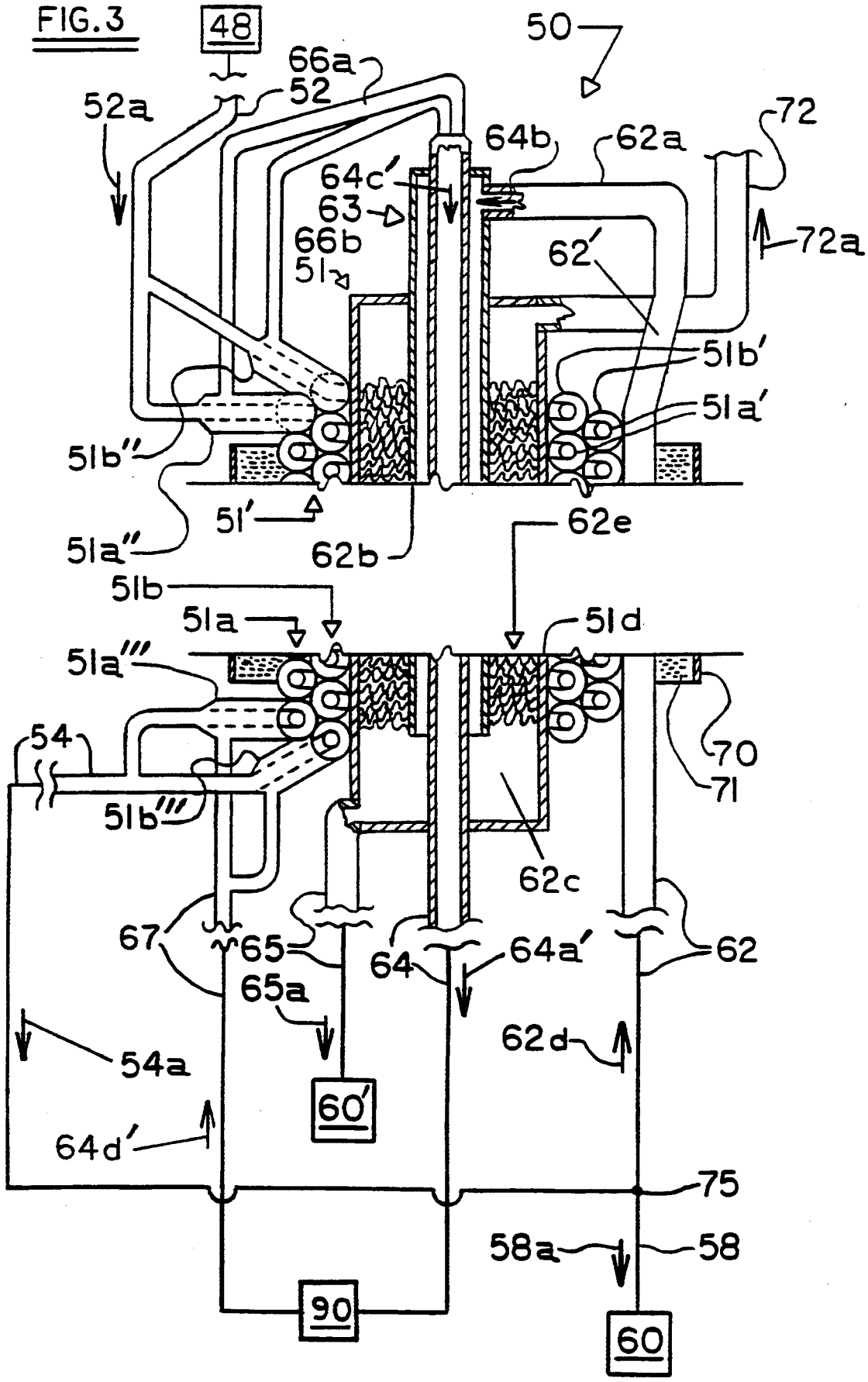
FIG. 3 is a vertical sectional view, partly schematic similar to FIG. 2 showing the separation vessel and other components of the apparatus in an alternate vertical form.

FIG. 3 illustrates an alternate form of the apparatus shown in FIG. 2 wherein the refrigerant from source 48 to be treated is discharged from conduit 52 into inner tubular member 51*a* of uppermost end spiral coils 51*a''* and 51*b''* adjacent the uppermost end of the external exchanger 51', and the heat extraction substance is conveyed into the lowermost outer tubular members 51*a'''* and 51*b'''*.

It also illustrates a reversal in the flow of the heat extraction substance. The direction of flow of heat extraction substance from device 90 in this form is represented by arrow 64*d'* through conduit 67 from the discharge outlet of device 90 and into the outer tubular members 51*b'* of the lowermost spiral coils 51*a'''* and 51*b'''*. The heat extraction substance flows through the outer tubular members to be discharged from uppermost spiral coils 51*a''* and 51*b''* into the conduits 66*a* and 66*b* connected therewith and into the inner tube 64 of the internal heat exchanger 63. The heat extraction substance flows from the lower end of the tube or conduit 64 in the direction represented by the arrow 64*a'* back to the inlet of the device 90.

The discharge of collected liquid between or following heat extraction steps and the operation of this form is the same as described with regard to FIG. 2, except as noted above. Also, either or both above described modifications can be made. That is, the flow of refrigerant may be modified as described above and the flow of heat extraction substance may remain the same as described in FIG. 2. Similarly, the flow of heat extraction substance may be changed as above described and the flow of refrigerant may remain the same as described with regard to FIG. 2. Like reference numerals in FIG. 3 are used to correspond to the same components with the same reference numerals in FIG. 2.

Figure 4:
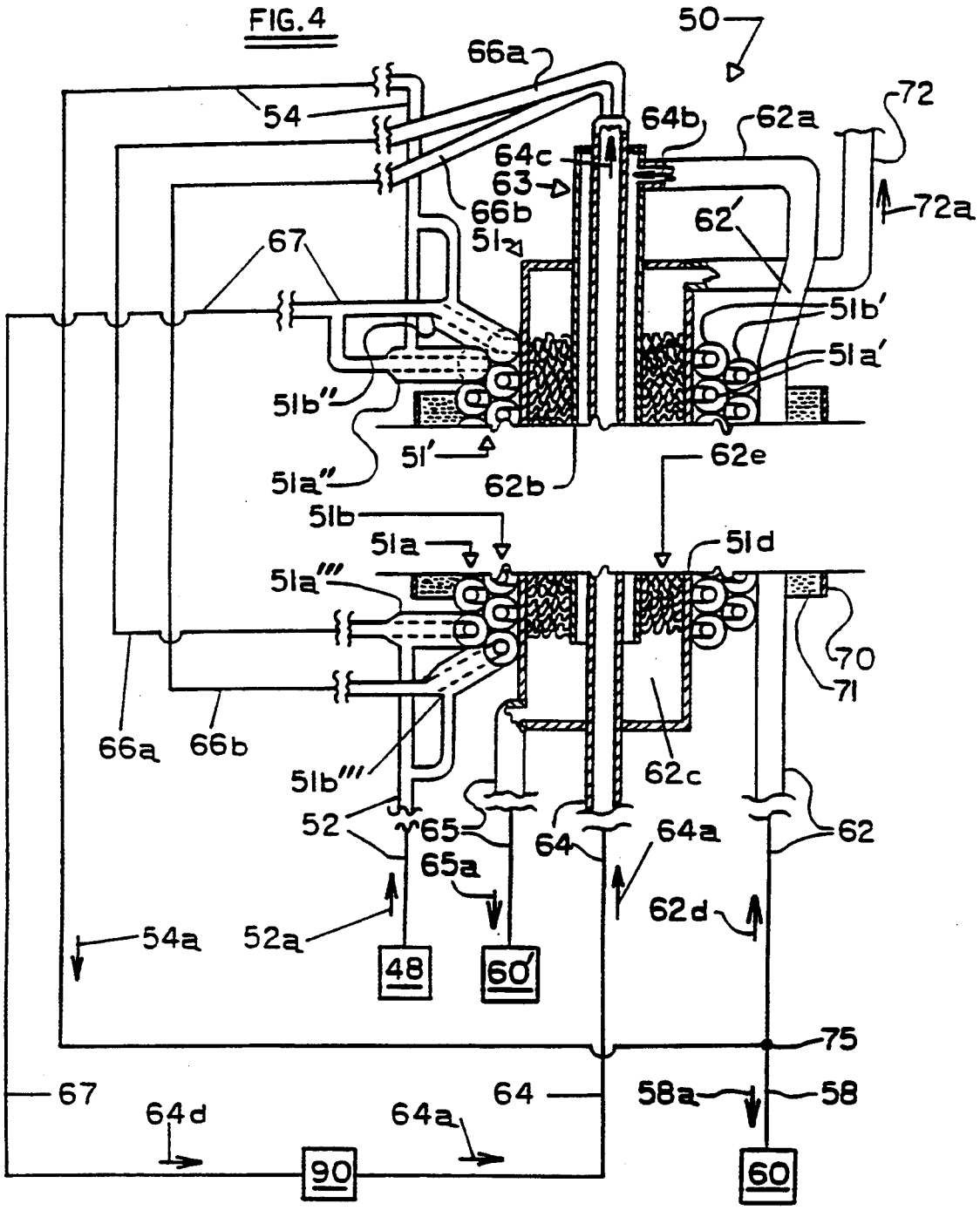
FIG. 4 is a vertical sectional view, partly schematic similar to FIG. 2 showing the separation vessel and other components of the apparatus in another alternate vertical form.

FIG. 4 shows another alternate vertical form of FIG. 2 wherein the conduit 52 that is connected with source unit 48 is connected with the lowermost spiral coils 51*a'''* and 51*b'''* of the external heat exchanger to supply the refrigerant being treated adjacent the bottom of the external heat exchanger 51'.

FIG. 4 also illustrates an alternate flow arrangement of the heat extraction substance from the internal heat exchanger 63 to the external heat exchanger 51'. Conduits 66*a* and 66*b* are connected with the inner tubular members 51*a'* of the lowermost end spiral coils 51*a'''* and 51*b'''* of the external heat exchanger 51'. Also, conduit 67 is connected with the inner tubular members 51*a'* of the uppermost end spiral coils 51*a''* and 51*b''* as seen in FIG. 4 for conducting the heat extraction substance from adjacent the upper end of the heat exchanger 51' back to device 90 after it has passed through the external heat exchanger 51'. The change directing the flow of refrigerant to be treated to the lower end of the external heat exchanger may be made independently of the change in directing the flow of heat extraction substance into the lower end of the external heat exchanger. Also the change in directing the flow of heat extraction substance into the lower end of the external heat exchanger may be made independently of the change directing the flow of refrigerant to the lower end of the external heat exchanger.

As another alternate form for that shown in FIG. 4, the heat extraction substance may be discharged from the internal heat exchanger into the outer tubular members 51*b'* and the refrigerant to be treated may be discharged from conduit 52 into the inner tubular members 51*a'* of the external heat exchanger 51'.

The remainder of the operation and flow of the refrigerant through the separation vessel, conduits and associated components of the alternate FIG. 4 form is the same as that as described with regard to FIG. 2.

Like reference numerals in the alternate FIG. 4 forms are used to correspond to the same components with the same reference numerals in FIG. 2.

By rotating the vessel 50 90 degrees counter clockwise from the position shown in FIG. 2 of the drawings, vessel 50 assumes a horizontal operating position and form as illustrated in FIGS. 5–7 inclusive.

In this event the uppermost end spiral coils 51*a''* and 51*b''* shown in the vertical operating position in FIG. 2 are referred to herein as the left end spiral coils in the horizontal position in FIGS. 5–7 and the lowermost end spiral coils 51*a'''* and 51*b'''* of the vertically positioned separation vessel 50, as shown in FIG. 2, are referred to as the right end spiral coils in FIGS. 5–7.

When the vessel 50 is in the horizontal position as seen in FIG. 5, condensed liquid refrigerant resulting from the heat extraction steps, or relationships, may flow by gravity through conduit 54, and then through conduit 58 which is connected to conduit 54 at a position below the intersection, or junction 75 of conduit 54 and conduit 62 as shown in FIG. 5. The liquid flows from conduit 58 into any suitable liquid separation device, such as by way of example only, the float trap represented at 60.

The operation and flow of the horizontal FIG. 5 form is the same as that described with regard to the FIG. 2 description except that the refrigerant to be treated is shown as conducted into the outer tubular members 51*b'* at or adjacent the left end of the external heat exchanger 51'. Also, the heat extraction substance is conducted from device 90 into the conduit 64 which extends into and through the right end of the vessel 50 instead of the lower end as described with regard to FIG. 2. Like numerals in FIG. 5 are used to correspond to the same components of FIG. 2.

Since the separation vessel is horizontal, the source 48 is on the left end of FIG. 5 and is connected by the conduit 52 to feed into the external heat exchanger 51' on the separation vessel 50.

The operation and flow of the horizontal FIG. 6 form is the same as that described with regard to vertical FIG. 2 description except that the refrigerant to be treated is conducted into the inner tubular members 51*a'* of spiral coils 51*a''* and 51*b''* at or adjacent the left end of the external heat exchanger 51'. Also, the heat extraction substance flows through conduit 67 from the discharge outlet of device 90 in this form as represented by arrow 64*d'* and into the outer tubular members 51*b'* of the spiral coils 51*a'''* and 51*b'''* adjacent or at the right end of the external heat exchanger 51'. Like reference numerals in FIG. 6 are used to correspond to the same components of FIG. 2 with the same reference numerals.

Since the separation vessel is horizontal, the source 48 is on the left end of of FIG. 6 and is connected by the conduit 52 to feed into the external heat exchanger 51' on the separation vessel 50.

The operation and flow of the horizontal FIG. 7 form is the same as that described with regard to the FIG. 4 description except that the refrigerant to be treated is conducted into the right end of the external heat exchanger 51' instead of the lower end of the external heat exchanger as described with regard to FIG. 4. Also, the heat extraction substance is flowed from device 90 into the conduit 64 as represented by arrow 64*a* which conduit extends into and through the right end of the vessel instead of the lower end as described with regard to FIG. 2. The separation vessel is horizontal and the source 48 is connected by the conduit 52 to feed into the right end of the external heat exchanger 51' of FIG. 7 on the separation vessel 50. Like reference numerals in FIG. 7 are used to correspond to the same components which are in FIG. 2.

In all vertical and in horizontal forms of the invention, the other components including the conduits and traps preferably should assume the same relationship to the vessel 50 and each other as shown in the drawings relating to the vertical form and horizontal form, respectively.

The same reference numerals are used throughout in each of the drawings to correspond to the same components.

Where the separation vessel 50 is horizontal, the conduit 72 should preferably come out of the top side and conduit 65 preferably should come out on the bottom side of the housing 51 as shown in FIGS. 5–7. In all forms of the invention, the conduits 58 and 65 are shown as extending downward relative to separation vessel 50 since the liquid portion drains by gravity to the liquid separation devices 60 and 60'. The other components including the conduits and traps should preferably assume the same relationship position wise to the vessel 50 as shown in the drawings to function properly.

The vessel 50, as shown in a horizontal position in FIGS. 5–7, may be rotated 180 degrees about the longitudinal axis of conduit 64. In other words, if the left end of the device shown in FIG. 5 is lifted up out of the plane of the paper and rotated 180 degrees, the left end becomes the right end and the right end becomes the left end. The conduit and trap arragement remain the same as shown in FIGS. 5–7, and the operation is the same as described with regard to FIGS. 5–7.

Also, the vessel 50, as shown in a horizontal position in FIGS. 5–7, may be rotated in the plane of the paper 180 degrees in either a clockwise or counter clockwise direction about the longitudinal axis of conduit 64. It may be operated in such position by eliminating the inclined portion 62' in conduit 62 so that conduit 62 may drain to a trap, not shown. In such position, conduit 72 becomes the liquid drain for housing 51 and conduit 65 becomes the non condensible gas outlet from housing 51.

This is accomplished by replacing trap 60' with a suitable relief device, as previously described, for discharge of the non condensible gas(es) to atmosphere; trap 60' is moved and reconnected with conduit 72 at a position below the vessel 50 to allow the liquid to flow by gravity into trap 60; conduit 58 is disconnected from junction 75 and conduit 54 is connected to conduit 62; conduit 58 is reconnected with conduit 62 to intersect conduit 62 below the horizontal portion of conduit 62 prior to its contact with outer coil layer 51*a;* trap 60 is relocated to any suitable location below conduit 58 to allow the liquid to flow by gravity from conduit 62 through conduit 58 into trap 60.

Figure 8:
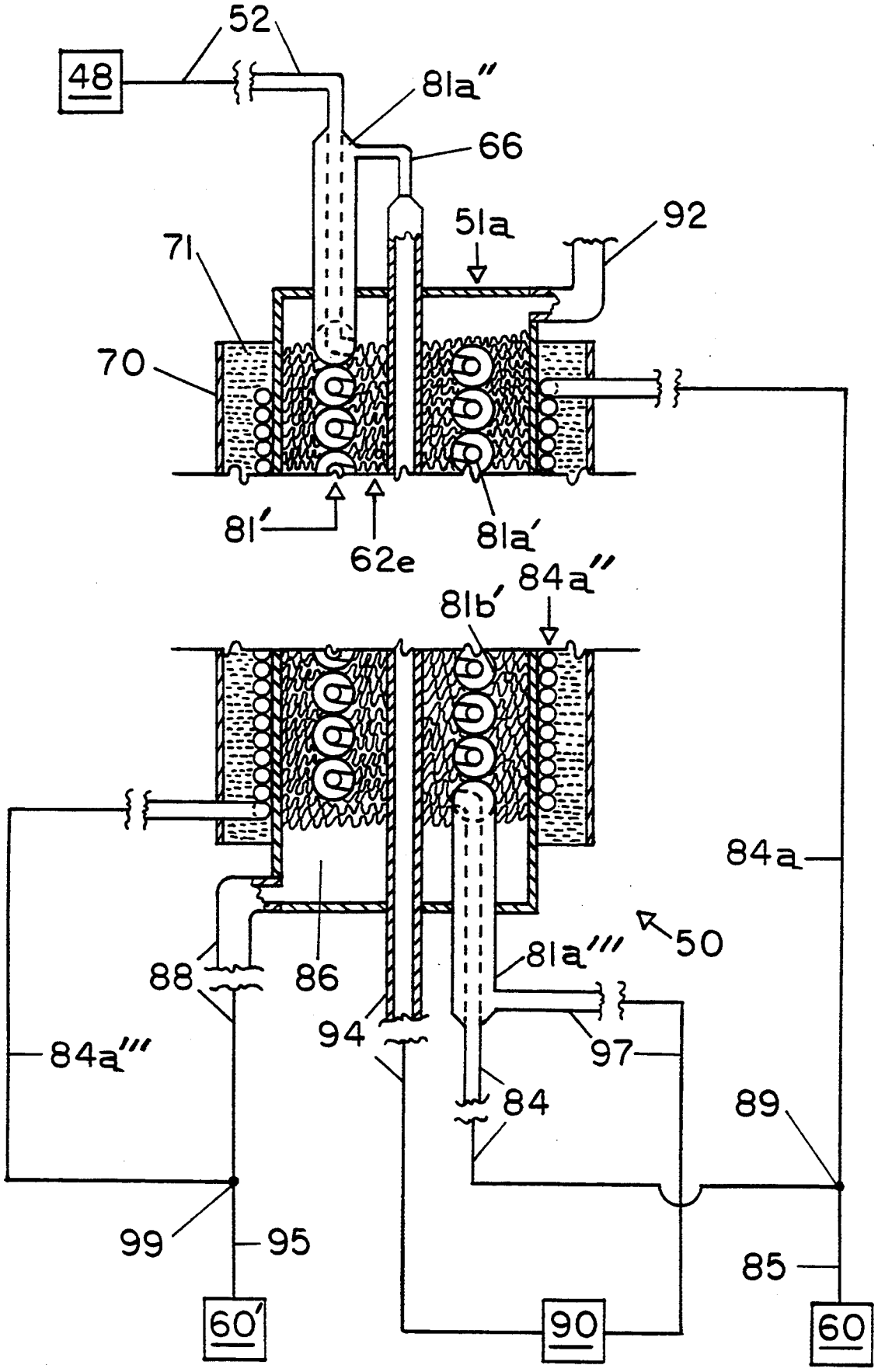
FIG. 8 is vertical sectional view, partly schematic of an alternate vertical form of the invention.

In another vertical form, the external heat exchanger 51' as shown in FIG. 2 may be omitted and the internal heat exchanger may be a spiral coil type heat exchanger 81' as shown in FIG. 8. When the internal heat exchanger and vessel 50 are in a vertical position as shown in FIG. 8, the refrigerant may be fed from source 48 through conduit 52 into either the inner or outer tubular members 81*a'* or 81*b'* of uppermost spiral coil 81*a''* of the heat exchanger 81', and is shown in FIG. 8 as being conducted into the inner tubular member 81*a'*.

The heat extraction substance is supplied from device 90 through conduit 94 which extends through and is sealably connected with the upper and lower ends of vessel 50 as shown. The portion of conduit 94 within the vessel 50 functions as a heat extraction tube and withdraws heat from the substance or baffle means 62*e* in space 86 when the remaining gas portion is recirculated back through the vessel as will be described. Conduit 66 is connected with the upper end of conduit 94 and conducts the heat extraction substance to the outer tubular member 81*b'* of the uppermost coil 81*a''* in heat exchange relationship with the refrigerant flowing in the inner tubular members 81*a'*. Alernativly, the heat extraction substance may be flowed to the inner tubular member 81*a'* and the refrigerant flowed thorugh the outer tubular member 81*b'* in heat exchange relationship.

A suitable substance or flow turbulence inducer, such as baffle means either or both of which may be considered flow turbulence inducers are referred to generally at 62e, is positioned in space 86 in the vessel 50 adjacent or around the internal spiral type coil heat exchanger and is illustrated in FIG. 8 as being a suitable substance which causes the gas portion to change directions as it flows therethrough to subject the gas to a heat extraction step for condensing refrigerant to a liquid. Any suitable porous heat conductive substance may be employed in granular or any other form which causes the gas flowing there through to change directions. By way of example only, copper, aluminum, diamonds, brass, stainless steel, silver and gold may be used in this form as well as in space 62c of the other forms. The baffle means may be likewise of heat conductive material with openings therein for flow there through. The baffle means may be secured in the space 86 in a manner to most effectively function to condense the refrigerant in the remaining gas portion to liquid.

The heat extraction substance, as well as the refrigerant to be treated can flow into the internal spiral coil type heat exchanger from either the upper end or the lower end, when the vessel 50 is in vertical position, or the right or left end when the vessel 50 is in the horizontal position as described with regard to the other embodiments.

The liquid and gas portion of the refrigerant flows through a conduit 84 from the internal heat exchanger 81'. Any suitable liquid separation device or liquid trap may be located below and adjacent the lower end of the vessel 50 to receive liquid, whether the vessel is in a vertical or horizontal position or at any angle between horizontal and vertical. Conduit 85 intersects the conduits 84 and 84a at junction 89 at an elevation higher than the liquid trap, as shown in FIG. 8 and the liquid portion flows by gavity to th trap 60. The first heat extraction step as the refrigerant passes through the internal spiral coil type exchanger 81' is a primary heat exchange relationship and the heat extraction step through the flow turbulence arrangement generally referred to as 62e is a secondary heat exchange relationship.

The liquid flows from the trap to a predetermined location as described herein above with regard to the other forms. The non condensible gasses are then discharged or expelled from the vessel 50 through a conduit 92 adjacent the upper end thereof as shown in FIG. 8.

The internal heat exchanger coils are shown as spaced from the inner surface of the walls of the vessel housing 51, but they may be in contact with the housing walls to provide a form of a heat sink.

The same alternate embodiments may be made to this embodiment as are described with regard to FIG. 2.

A spiral coil type heat exchanger formed by coil members similar to coil members 81a' and 81b' as better illustrated in FIG. 8, may be substituted for the tube type internal heat exchanger 63 in the housing 51 in all forms of the apparatus.

The external coil type heat exchanger 51' and the internal tube type heat exchanger 63 may be considered as primary heat exchangers and the heat extraction substance from device 90 flows through each. Each of these heat exchangers may have their individual liquid drain conduits as represented at 65 for the internal heat exchanger 63 and conduit 58 for external heat exchanger 51'.

Any suitable form or type of apparatus, device or equipment, such as by way of example and and not by way of limitation, a refrigeration unit, sometimes referred to herein as a device, represented at 90, that is capable of supplying a heat extraction substance, such as by way of example only and not by way of limitation any suitable refrigerant fluid well known to those skilled in the art such as, by way of example only, chilled water, R-22, R-12, R-502, R-500, R-134a, R 69-L, R 69-S is preferred to provide a heat extraction substance, to flow preferably first from the refrigerant source 90 to the second heat exchanger 63, and is then conducted to the first heat exchanger 51' as described hereinabove.

The present invention is not limited to using only one heat extraction substance, and has the capability of using any one of a multiple number of heat extraction substances such as, by way of example only and not by limitation, water, water solutions and thermal fluids or any of the above refrigerant fluids.

The external heat exchanger 51' has been described as preferably being externally of the housing 50 and as having 2 layers of coils, but it can be appreciated that one layer or more than two layers can be used.

The heat extraction substance from device 90 is preferably conveyed into the lower end of conduit 64 as shown in FIG. 2. However, device 90 may be connected with the upper end of conduit 64 and convey heat extraction substance into the upper end of vessel 50. In this form, the conduits 66a and 66b are disconnected from the upper end of the conduit 64 as shown in FIG. 2 and reconnected with the lower end of conduit 64. The conduits 66a and 66b may remain connected with uppermost coils 51a'' and 51b'' as shown in FIG. 2; they may also be disconnected from uppermost coils 51a'' and 51b'' and then reconnected with the lowermost coils 51a''' and 51b'''.

The vessel 50, may be operated in an in any position between the vertical position of FIGS. 1–4 and the horizontal forms shown in FIGS. 5–7 of the drawings drawings when it is rotated from vertical to horizontal in a counter clock wise direction.

In all forms of the invention, the internal tube type heat exchanger 63 may be replaced in vessel 50 by a spiral coil type heat exchanger.

A straight tube type heat extraction means, such as, by way of example only, a straight conduit, as shown in FIG. 8 at 94 may be substituted in place of the heat exchanger 63. A coil tube type heat extraction conduit or means may be used instead of a straight tube type.

Where the internal heat exchanger 63 is not employed, as above described with regard to the FIG. 8 form shown, the conduit 62 as seen in FIGS. 1–7 is omitted.

In one flow arrangement with this embodiment, source 48 is connected by conduit 52 with inner tubular member 81a' of uppermost coil 81a'' of internal heat exchanger 81' for conducting refrigerant to be treated from source 48 to internal heat exchanger 81'.

Device 90 provides heat extraction substance, as seen in FIG. 8 through the lower end of conduit 94, which is shown as a straight heat extraction tube, and is discharged from conduit 94 out the upper end through conduit 66 to outer tubular member 81b' of uppermost coil 81a'' of the internal heat exchanger 81', as seen in FIG. 8.

A heat extraction relationship is thus effected with the refrigerant passing through the internal heat exchanger. The heat extraction substance flows from the lower end of the internal heat exchanger back to inlet of device 90 conduit 97. The condensed refrigerant and gas portion being treated is discharged from the lowermost heat exchanger coil 81*a*''' to conduit 84.

When the vessel 50 is in the preferred vertical position the condensed liquid portion of the refrigerant flows by gravity through conduit 84, and then through conduit 85 which is connected to the conduit 84 as shown in FIG. 8 at a position below the intersection or junction 89 of conduit 84 and conduit 84*a* as shown in FIG. 8. The liquid flows from conduit 85 into any suitable liquid separation device, such as by way of example only, the float trap represented at 60, which allows only liquid to flow through the trap and the gas portion is trapped, or retained. Liquid condensed from the refrigerant in the first heat extraction step by the internal heat exchanger 81' may thus removed from the subsequent treatment steps to which the refrigerant is subjected.

The remaining gas portion flows through conduit 84, through junction 89 and conduit 84*a* into the upper end of spiral coil 84*a*'' wound around and in contact with the housing 51*a* so that the remaining gas portion is subjected to another heat extraction step. The refrigerant being treated leaves the lower end of spiral coil 84*a*'' through conduit 84*a*''' to the junction 99 of conduits 88 and 95. The liquid portion flows by gravity to trap 60', and the gas portion flows through conduit 88 into housing 51*a* where it is subjected to additional heat exchange steps by the flow turbulence inducer in a manner as previously described with regard to FIG. 2 and by the heat extraction tube and internal heat exchanger to further treat the refrigerant.

The uncondensed gases are discharged from housing 51*a* through conduit 92. The condensed refrigerant flows by gravity from housing 51*a* through conduit 88 and conduit 95 to float trap 60'.

The liquid from the traps is conducted by a conduit (not shown) to a predetermined location as previously described with regard to FIG. 2.

Another form of that shown in FIG. 8 is provided by omitting external spiral coil 84*a*'' and connecting 84*a* directly to 84*a*''' for conducting refrigerant being treated into the housing 51*a* of the vessel where it is subjected to the same steps as described above, and the liquid and gas portions handled as above described. Since conduit 84*a* is directly connected to conduit 84*a*''' trap 60 may be omitted.

It is preferred in all forms that a liquid trap arrangement be provided for receiving liquid from each of the plural heat extraction steps, which arrangement may be any suitable number of traps, one or more as desired, or necessary.

With the exception of the insulation 71 and jacket 70, as shown in FIG. 2, preferably all components of vessel 50 are formed of good heat transfer qualities, such as by way of example only and not by way of limitation, copper, aluminum, or other materials well know to those skilled in the art.

The present invention is described in detail where the heat extraction means are heat exchangers, but heat extraction jackets, tube means, straight, or coil type or other forms of heat extraction devices may be incorporated in the present invention with minimum modifications in light of the disclosures contained herein by any person skilled in the art.

The following description of vessel components and size and assembly is by way of illustration only and is not presented or intended as a limitation. The vessel size is mainly dependent upon the maximum volume of refrigerant to be treated by the apparatus and method of the present invention. It is preferred that the separation vessel be as small and compact as possible for mounting in or with different size source units, for ease of transportation and mobility while accommodating as large a volume as possible to accomplish the refrigerant treatment as quickly as possible and still maintain a minimum discharge of refrigerant to the atmosphere with the gases. The capacity of the separation vessel may be increased in various ways, such as by way of example only, adding more coil layers to external heart exchanger 51', converting conduit 62 to a spiral coil pipe and wrapping it around and in contact with the outer coil layer 51*a* on the external heat exchanger 51', converting conduit 62 from a secondary into a primary heat exchanger by adding coils thereto, by operating or connecting two or more separation vessels in a parallel flow configuration, by enlarging the housing and heat exchanger dimensions.

One example of a preferred vessel size is a housing 51 length of approximately 26 inches; housing O. D. diameter of approximately 3.125 inches; vessel 50 length approximately 34 inches; and vessel 50 width approximately 6 inches.

All copper employed in the apparatus is preferably refrigeration grade type L soft rolled or hard copper pipe as will be identified. All copper fittings are preferably refrigeration grade.

The following dimensions are by way of example only for one vessel size.

The tubular member 64 is preferably of hard copper pipe 45 inches long and 0.625 inches outside diameter. Tubular member 62*b* is hard copper pipe 26 inches long and 0.875 inches outside diameter. Tubular member 51*d* is hard copper pipe 20 inches long and 3.125 inches outside diameter. Heat exchanger 51' comprises tubular member 51*a*' which is soft copper tube about 22 feet long and 0.375 inches outside diameter. Member 51*b*' is soft copper about 22 feet long and 0.625 inches outside diameter. Tubular member 62 is soft copper about 32 inches long and 0.625 inches outside diameter. Tubular member 65 is hard copper about 6 inches long and 0.625 inches outside diameter. Tubular member 72 is hard copper about 7 inches long and 0.625 inches outside diameter. Tubular members 66*a* and 66*b* are soft copper about 13 inches long and 0.375 inches outside diameter. Tubular member 52 is about 7 inches long and 0.50 inches outside diameter. Tubular member 54 is hard copper about 2 inches long and 0.625 inches outside diameter. Tubular member 67 is hard copper about 6 inches long and 0.50 inches outside diameter. Jacket 70 is poly vinyl chloride sewer and drain pipe about 26 inches long and 6.25 inches outside diameter. The insulation 71 is preferably of any suitable insulation material such as expandable urethane foam. Tube 62*a* may be a short radius, 90 degree street elbow fitting about 1 and $\frac{1}{4}$ inches end to center and 0.625 inches outside diameter.

Members of the separation unit 50 may be connected in any suitable manner well known to those skilled in the art. One manner of connecting the components of the separation unit 50 is by soldering using a high temperature solder, well known to those skilled in the art.

By way of example only and not intended as a limitation, a system employing the apparatus as described hereinabove can receive a heat extraction substance flow of R-22 refrigerant from device 90 approximating 12,000 BTU per hour; the quantity of refrigerant that is conveyed to vessel 50 to be treated for separation into a gas portion and a liquid portion may be approximately up to eight cubic feet per minute measured at free air flow depending upon the type of refrigerant being treated; the safe operating pressure of the vessel 50 should not exceed 200 pounds per square inch. All associated and separate components must have at least the same safe operating pressure rating. The vessel 50 will separate the refrigerant being treated from non condensible gases and allow approximately six percent or less by volume of refrigerant R-11 to ninety four percent or more by volume of non condensible gases to be discharged to atmosphere. It can be appreciated that the above parameters may be changed by varying the size of the components, type of material or other factors.

The foregoing description of the invention is illustrative and explanatory thereof, and various changes in the details of the illustrated construction may be made without departing from the spirit of the invention as defined in the following claims.

What is claimed is:

1. A separation vessel for connection with a refrigerant source in a vertical position, a horizontal position and in any position between vertical and horizontal to condense the refrigerant from the source to form a liquid portion and a gas portion for discharge from the separation vessel, said separation vessel including:

a longitudinally extending housing having an exterior surface forming an exterior side surface oriented around a longitudinal axis;

said exterior surface additionally forming a top side and a bottom side respectively disposed at the opposite ends of said longitudinal axis;

first conduit means connected with said longitudinal extending housing for receiving the refrigerant to be condensed into a liquid portion and a gas portion;

heat extraction means associated with said longitudinally extending housing to condense the refrigerant to form a liquid portion and a gas portion;

liquid trap means for receiving the liquid portion;

second conduit means connected to said top side of said longitudinally extending housing to discharge the gas portion from said longitudinally extending housing when said longitudinally housing is in a vertical position, a horizontal position and in any position between vertical and horizontal; and third conduit means connected to said bottom side of said longitudinally extending housing and to said trap means; said separator vessel defining means to conduct the condensed liquid portion from said longitudinally extending housing to said liquid trap means when said longitudinal axis of said longitudinally extending housing is disposed alternatively in a vertical orientation, a horizontal orientation and in any orientation between vertical and horizontal.

2. The separation vessel of claim 1 wherein said heat extraction means is a plurality of heat extraction means to provide a plurality of heat extraction relationships and wherein said liquid trap means traps and separates the condensed liquid portion at each of said plurality of heat extraction relationships and prior to the next heat extraction relationship.

3. The separation vessel of claim 1 for use with a source means which is any selected from the group comprising a purge unit, a recovery unit, a recycle unit and any combination of said units.

4. Apparatus for condensing a refrigerant from one or more non-condensible gasses to form a liquid portion and a gas portion including:

a separation vessel;

a first heat extraction arrangement supported by said separation vessel for receiving refrigerant gas and condensing at least a portion of the refrigerant gas to liquid with a remaining gas portion;

a second heat extraction arrangement supported by said separation vessel for receiving the remaining gas portion of the refrigerant to further condense at least a portion of the remaining refrigerant to a liquid portion with a remaining gas portion;

liquid trap means for receiving the liquid portion condensed by the first and second heat extraction arrangement;

conduit means for connecting said first heat extraction arrangement and said second heat extraction arrangement;

said separation vessel including a housing having an exterior surface and further including:

a flow turbulence inducer comprising any porous heat conductive matter in said housing to further attempt to separate the refrigerant into a liquid portion and a gas portion and wherein said first heat extraction arrangement is mounted externally on said housing exterior surface and said second heat extraction arrangement is in said housing.

5. A method of separating a refrigerant from a source into a gas portion and a condensed liquid portion comprising the steps of:

providing a separation vessel that is capable of functioning alternatively in either a vertical position, a horizontal position or any position therebetween positioning said separation vessel in any desired position from vertical to horizontal;

conducting the refrigerant from a source to the positioned separation vessel and subjecting the refrigerant to a plurality of heat extraction relationships with a heat extraction substance to at least partially separate the refrigerant into a gas portion and a condensed liquid portion at each of the plurality of heat extraction relationshps;

trapping and separating the condensed liquid portion from the refrigerant at each of the plurality of heat extraction relationships and prior to the next heat extraction relationship of the positioned separation vessel whereby the remaining gas portion of the refrigerant is treated at each heat extraction relationship with a heat extraction substance to further separate the refrigerant into a gas portion and a liquid portion.

6. The method of claim 5 including the steps of discharging the heat extraction substance from each heat extraction relationship in multiple streams; and conducting each stream separately into the next heat extraction relationship.

7. A method of separating a contained refrigerant received from a source into a gas portion and a condensed liquid portion by subjecting the refrigerant to heat extraction relationships with a heat extraction substance in a separation vessel comprising the steps of:

providing a separation vessel that is capable of functioning alternatively in either a vertical position, a horizontal position or any position therebetween positioning said separation vessel in any desired position from vertical to horizontal;

conducting the refrigerant to the positioned separation vessel from the source;

subjecting the refrigerant to a plurality of heat exchange relationships in the separation vessel to at least partially separate the contained refrigerant into a gas portion and a condensed liquid portion; and trapping and separating the liquid portion from the refrigerant at selected heat exchange relationships.

* * * * *